US006886602B1

(12) United States Patent
Debuf et al.

(10) Patent No.: US 6,886,602 B1
(45) Date of Patent: May 3, 2005

(54) METHOD FOR DRIVING ONE OR SEVERAL PILE CARRIERS FOR THE SELECTION OF ONE OR SEVERAL PILE YARNS

(75) Inventors: Geert Debuf, Drongen (BE); Koen Bruynoghe, De Pinte (BE); Peter Garnett, Morpeth-Northumberland (BE)

(73) Assignee: N. V. Michel Van de Wiele, Kortrijk/Marke (BE)

( * ) Notice: Subject to any disclaimer, the term of this patent is extended or adjusted under 35 U.S.C. 154(b) by 121 days.

(21) Appl. No.: 10/400,931

(22) Filed: Mar. 28, 2003

(30) Foreign Application Priority Data

Mar. 29, 2002 (BE) ..... 2002/0227

(51) Int. Cl.[7] ..... D03D 39/00

(52) U.S. Cl. ..... 139/7 R; 139/7 A; 139/7 B; 139/7 C

(58) Field of Search ..... 139/7 A, 7 B, 139/7 C, 7 R

(56) References Cited

U.S. PATENT DOCUMENTS 5,255,538 A * 10/1993 Day et al. ..... 66/71
5,806,568 A * 9/1998 Dewispelaere et al. ..... 139/2
6,289,938 B1 * 9/2001 Dewispelaere ..... 139/7 A

FOREIGN PATENT DOCUMENTS

EP 0785301 7/1997
EP 1029959 8/2000
EP 1156146 11/2001
GB 2231590 11/1990
GB 2367076 3/2002

* cited by examiner

*Primary Examiner*—John J. Calvert
*Assistant Examiner*—Robert H Muromoto, Jr.
(74) *Attorney, Agent, or Firm*—James Creighton Wray; Meera P. Narasimhan

(57) ABSTRACT

The invention relates to a method for driving one or several pile carriers (2) for the selection of one or several pile yarns (15), the pile carriers (2) moving between a first and a second extreme position for pile selection, each pile carrier (2) being directly driven through a drive motor (4), and activating the drive motor (4) for driving the pile carrier (2) occurring either according to the half reset principle, the pile carrier (2), each time being moved over an intermediate position, this intermediate position being a position between two extreme positions for pile selection, and the position of the pile carrier (2) being verified in this intermediate position, or occurring without half reset, one half reset movement being carried out in verification of the fact whether all pile carriers (2) are still in the positions verified, after a number of movements of the pile carrier (2) or after a certain time, said half reset movement being a movement of one or several pile carriers towards an intermediate position between two extreme positions for pile selection before moving to a next position for color selection.

4 Claims, 4 Drawing Sheets

METHOD FOR DRIVING ONE OR SEVERAL PILE CARRIERS FOR THE SELECTION OF ONE OR SEVERAL PILE YARNS

This application claims the benefit of Belgian Application No. 2002/0227 filed Mar. 29, 2002.

The invention relates to a method for driving one or several pile carriers for the selection of one or several pile yarns.

Such a method is described in GB 2347687, where a mechanical Jacquard machine for a gripper axminster weaving machine is built in a horizontal direction and where there is a positive control of the pile carriers. In this method, the reset position of the pile carriers is situated in an extreme position. The pile carriers moving towards this extreme position are driven by a rod provided with grooves.

A disadvantage of this method is that the reset position of the pile carriers is situated in an extreme position, because of which the working speed of the weaving machine to be reached is restricted.

In EP 785 301 a method is described, where the pile carrier is moving from a position in a first weaving cycle to a position in a second weaving cycle according to a direct path without moving towards an intermediate reference position (reset position).

The disadvantage of such a method is that it is not possible here to verify whether all pile carriers are moving along an exact path. It is no longer possible to recognise if a pile carrier to get stuck or if a pile carrier positioning one or more steps mistakenly.

SUMMARY OF THE INVENTION

The objective of the invention is to provide for a method for driving one or several pile carriers for the selection of one or several pile yarns, the pile carriers moving between a first and a second extreme position for pile selection, and each pile carrier being directly driven through a drive motor, the exact positioning of the pile carrier being verified and the moving of the pile carriers leading to a shorter cycle time and therefore to an increased weaving speed.

This objective may be attained by providing for a method for driving one or several pile carriers for the selection of one or several pile yarns, the pile carriers moving between a first and a second extreme position for pile selection, and each pile carrier being directly driven through a drive motor, and activating the drive motor for driving the pile carrier being effected according to the half reset principle, the pile carrier each time moving over an intermediate position, this intermediate position being a position between two extreme positions for pile selection, and the position of the pile carrier being verified in this intermediate position.

A further objective of the invention is to provide for a method for driving one or several pile carriers for the selection of one or several pile yarns, the pile carriers moving between a first and a second extreme position for pile selection, and each pile carrier being directly driven through a drive motor, and each pile carrier being brought directly from the one to the other position for color selection and being verified from time to time whether the position of all pile carriers is still exact.

This objective may be attained by providing for a method for driving one or several pile carriers for the selection of one or several pile yarns, the pile carriers moving between a first and a second extreme position for pile selection, and each pile carrier being directly driven through a drive motor, and activating of at least one drive motor for driving a pile carrier occurs without half reset, after a number of movements of the pile carrier or after a certain time one half reset movement being carried out to verify whether all pile carriers are still in a verified position, said half reset movement being a movement of one or several pile carriers towards an intermediate position between the two extreme positions for pile selection before moving to a next position for color selection.

In a preferred method according to the invention, said intermediate position is the central position in the middle between the two extreme positions for pile selection.

In a preferred method according to the invention, verification of the central position of a pile carrier occurs by means of a light beam.

This invention will now be further explained by means of the following detailed description of a device, provided for implementing the methods according to the invention and two preferred methods for driving one or several pile carriers for the selection of one or several pile yarns according to the present invention. The intention of this description is exclusively to give a clarifying example and to indicate further advantages and particulars of this invention and therefore may on no account be considered to be a restriction of the field of application of the invention or of the patent rights set forth in the claims.

BRIEF DESCRIPTION OF THE DRAWINGS

In this detailed description reference is made by means of reference numbers to the attached drawings, in which.

DETAILED DESCRIPTION OF THE PREFERRED EMBODIMENTS

Figures 1, 2:
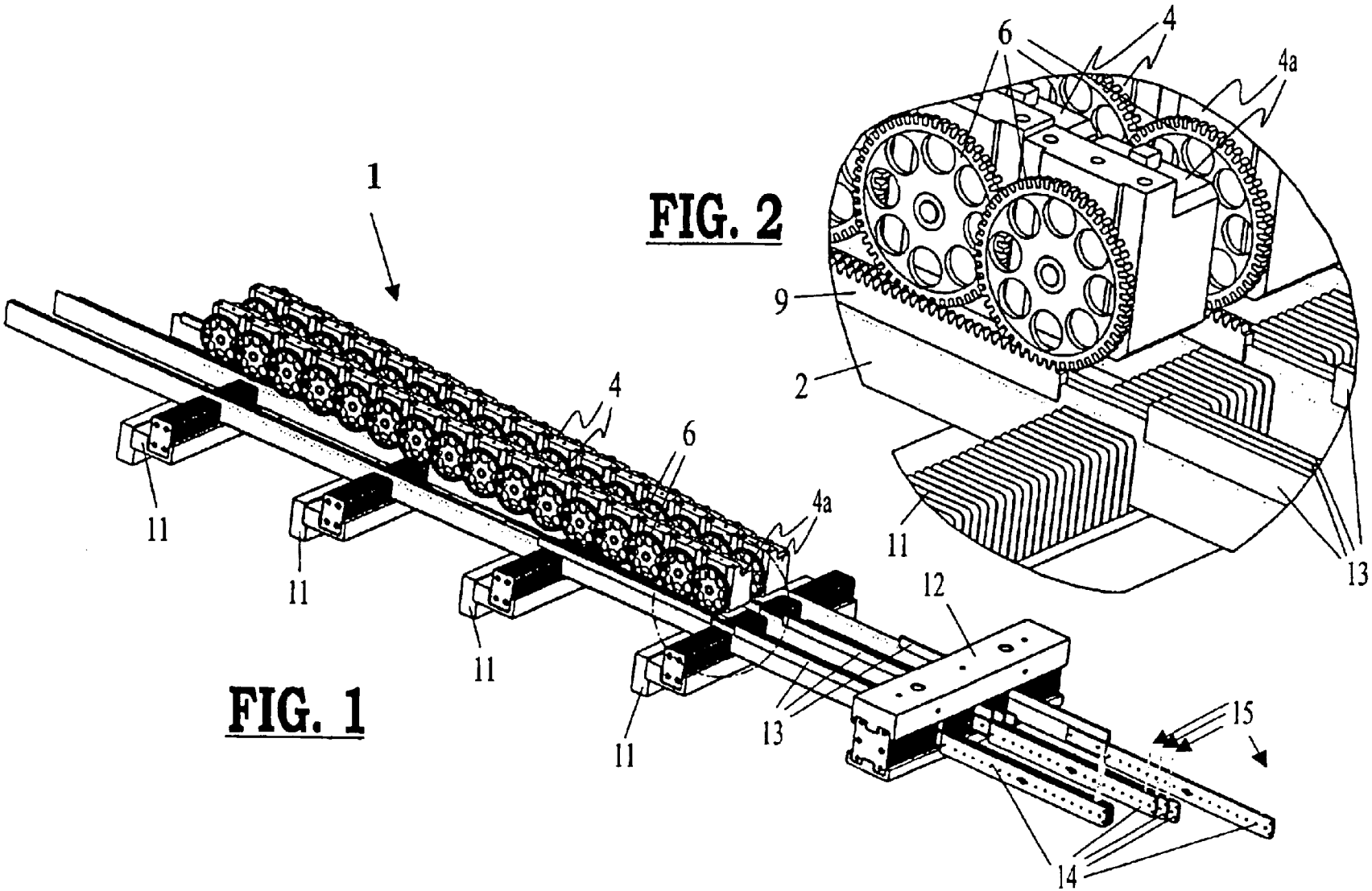
FIG. 1 is a perspective view of a device for driving one or several pile carriers for the selection of one or several pile yarns according to the invention.
FIG. 2 is a detail of the part indicated within a circle in FIG. 1.
Figure 3:
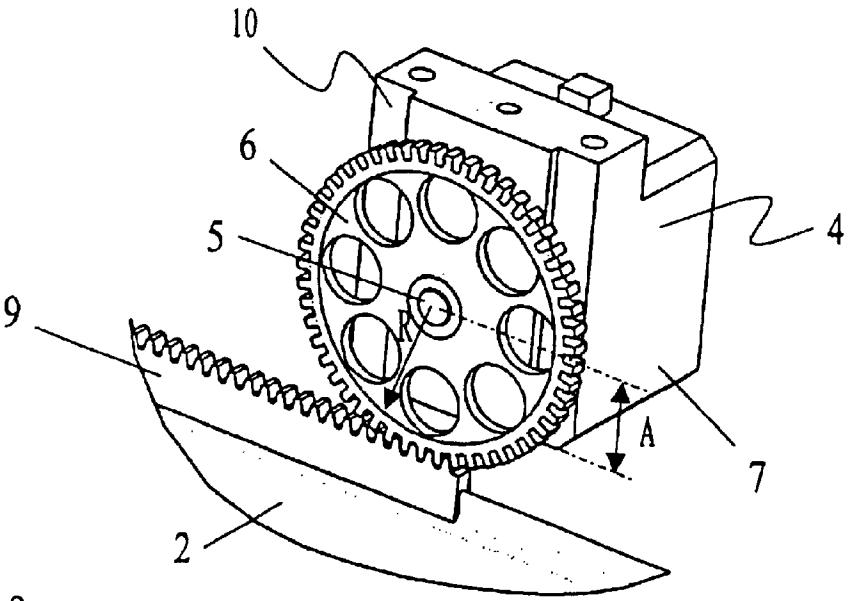
FIG. 3 is a detail of the part indicated within a circle in FIG. 4.
Figure 4:
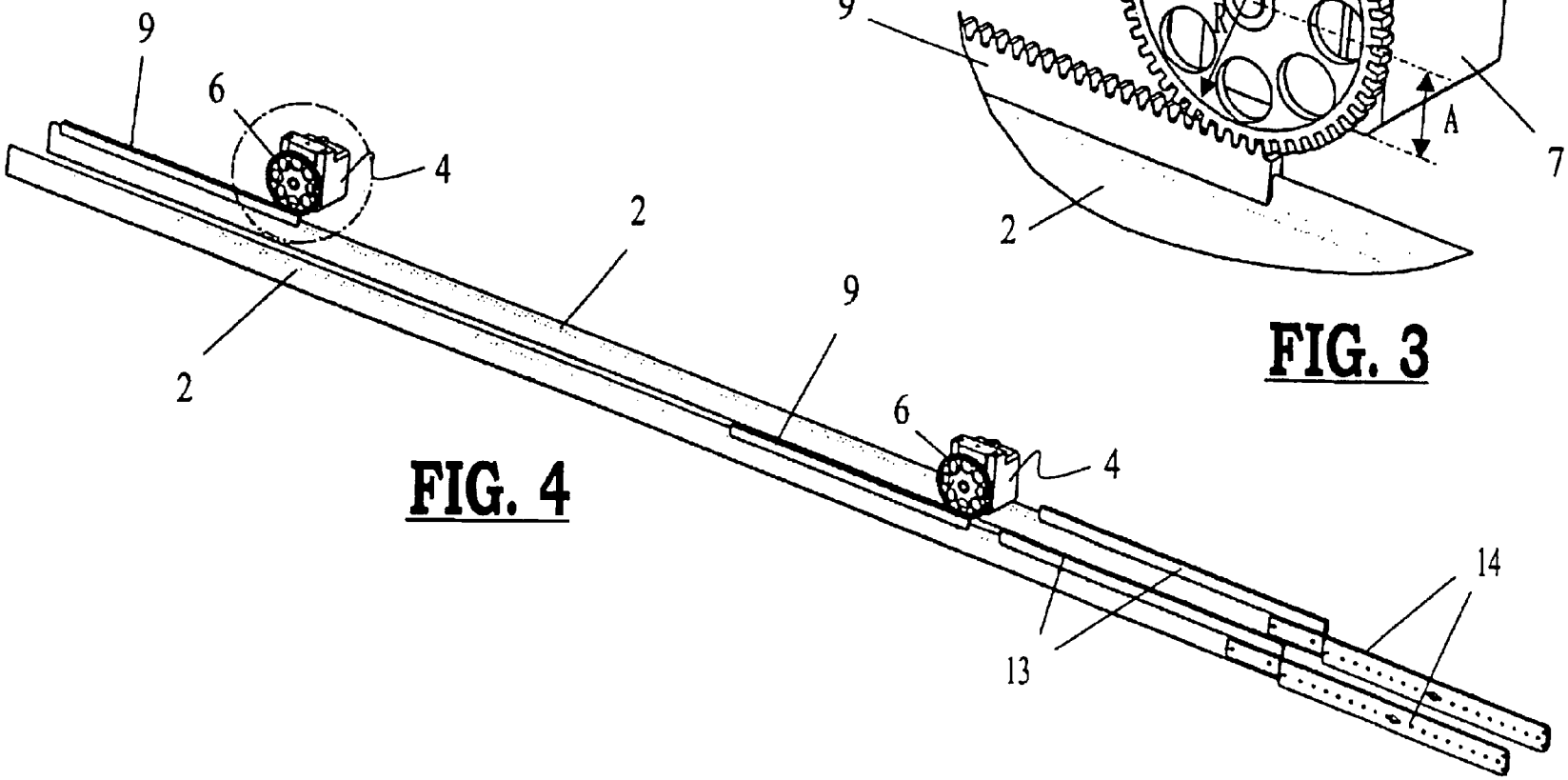
FIG. 4 is a perspective view of two pile carriers each being driven by a drive motor.

In a device (1) for driving one or several pile carriers (2) for the selection of one or several pile yarns (15) according to the invention, as represented in FIG. 1, one drive motor (4), more particularly a rotative drive motor, has been provided per pile carrier (2), as represented in FIGS. 3 and 4. These drive motors (4) are suspended from a structure above the pile carriers (2). The pile carrier (2) moving in a plane situated under the motor housing (7) of the drive motor (4). On the motor shaft (5) a gearwheel (6) has been installed having a radius, which exceeds the distance (A) between the motor shaft and the lower point of the motor housing (7). This gearwheel directly engages a toothed rack (9), made of synthetic material, attached to the pile carrier (2). The width of the gearwheel (6) and the toothed rack (9) practically equals the pitch of the pile carriers (2). Preferably, 16 pitches per length are bridged, 7 or 9 pitches being provided per 2.54 cm (corresponding to 1 inch).

Figure 5:
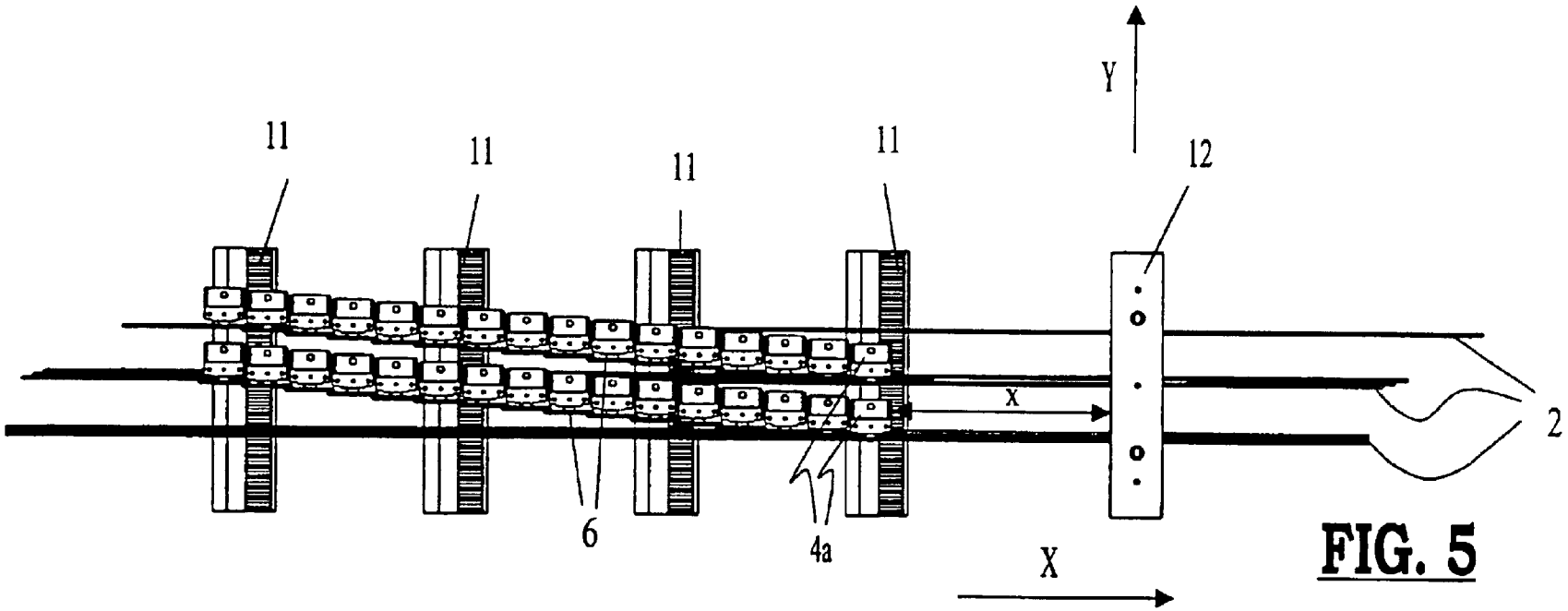
FIG. 5 is a top view of a device for driving one or several pile carriers for the selection of one or several pile yarns according to the invention.
Figure 6:
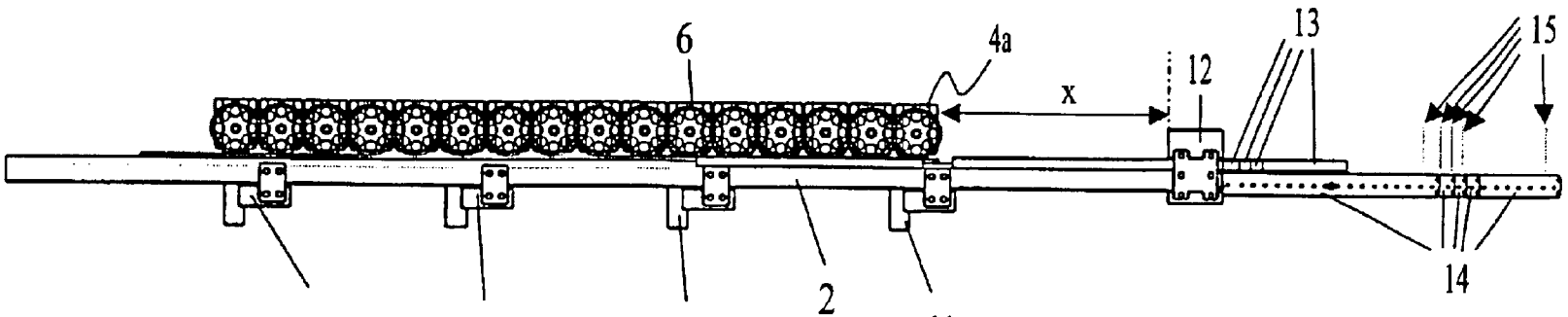
FIG. 6 is a side view of a device for driving one or several pile carriers for the selection of one or several pile yarns according to the invention.

The drive motors (4) are installed in one line according to the longitudinal direction (X) of the pile carriers (2), as represented in FIGS. 1, 5 and 6. These drive motors (4) are staggered over a pitch in a direction (Y) at right angles to the longitudinal direction (X) of the pile carriers (2), as may be seen in FIG. 2. The gearwheels (6) being likewise staggered over one pitch.

As may be seen in FIGS. 1, 2, 5 and 6, the gearwheels (6) are overlapping each other in the longitudinal direction (X) because of which the length of a line of motors in the longitudinal direction (X) is restricted or more motors may be installed over the same length.

To that effect, the motor housing (7) is provided with a recess (10) in which a gearwheel (6) driving an adjacent pile carrier (2) partly extends.

The pile carriers (2) are supported by at least three and preferably by four guiding reeds (11), as shown in FIGS. 1, 2, 5 and 6. In this manner an open reed guiding is obtained where the dust may fall down through the various guiding reeds (11) and cooling air may flow to the drive motors (4).

Figure 7:
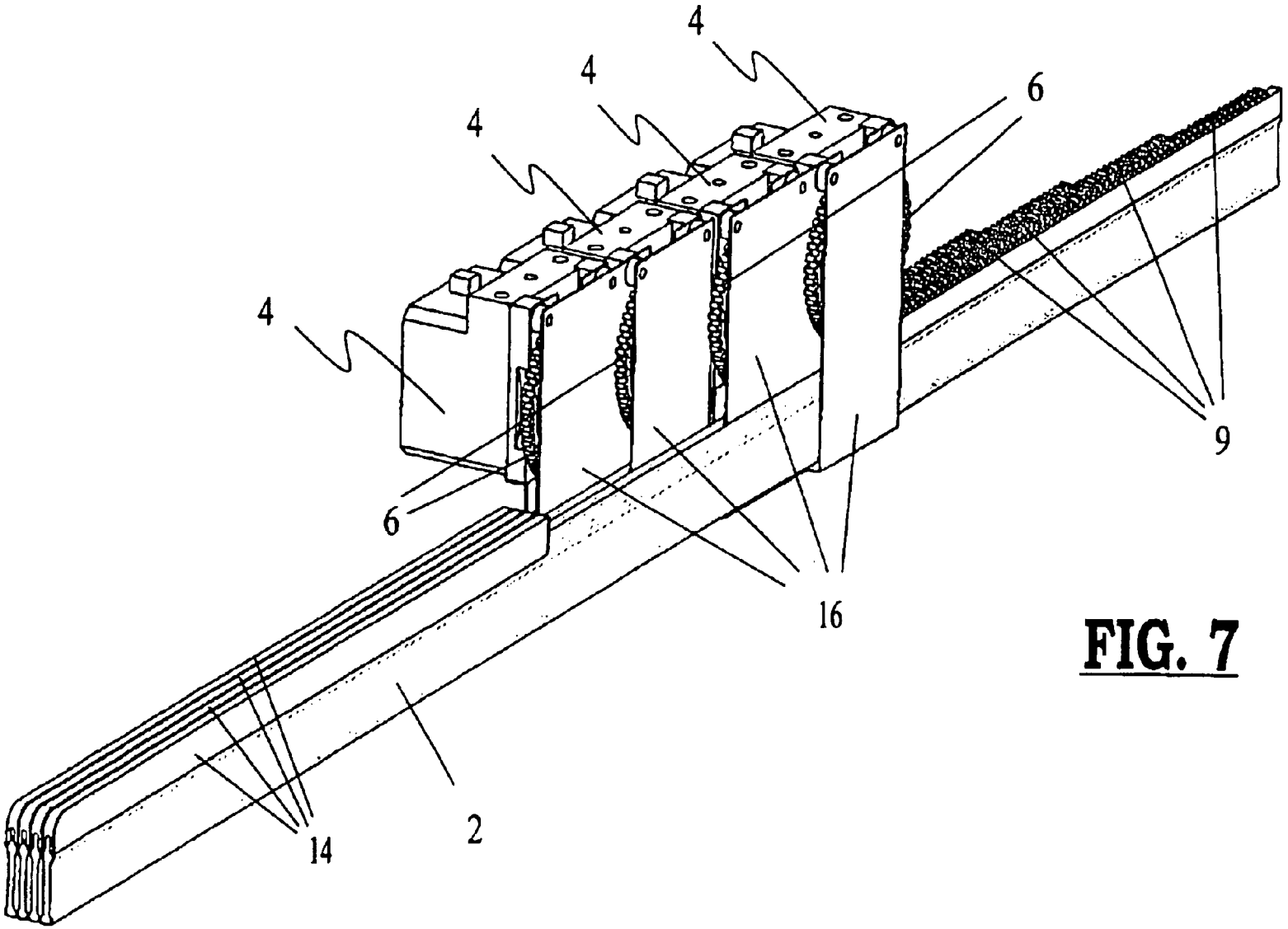
FIG. 7 is a perspective view of an alternative embodiment for guiding the pile carriers.

In an alternative embodiment for guiding the pile carriers (2), as represented in FIG. 7, guiding of the pile carriers (2) occurs through a toothed rack (9) through a guiding piece (16), attached to the drive motor (4) itself, for instance, attached to the motor housing (7) on the gearwheel (6) side, extending under the pile carrier (2), so that the connection between the drive motor (4) and the guiding piece (16) is a fixed one and is further less dependent on the temperature and less sensitive to vibrations.

This alternative embodiment has the advantage, with respect to the use of at least three guiding reeds (11), that no greater jamming can occur of the gearwheel (6) on the toothed rack (9) because of an expansion of the drive motor (4) and the gearwheel (6) due to the temperature. Another advantage is that in case of vibrations the contact between the gearwheel (6) and the toothed rack (9) in such an embodiment will be constant, what will not always be the case when using at least three guiding reeds (11).

Between the bundle of pile yarns (15) and the first drive motor (4*a*) of a line of drive motors (4), as represented in FIGS. 1, 5 and 6, a double-sided guide (12) is provided which is both supporting and avoiding the upward movement of the pile carriers (2) caused by the elastic retracting force of the pile yarn (15). The double-sided guide (12) is further used to absorb the tooth pressure and the deflection caused by the tooth forces. To that effect, in that place, the pile carriers (2) are provided with an additional guiding strip (13) extending above the upper surface of the pile carriers (2) over a certain length exceeding the stroke length, i.e. the maximum distance between the first and the last pile yarn (15), which has to be moved. The distance (x) between the double-sided guide (12) and the first drive motor (4*a*) of a line of drive motors (4), is such that the couple of forces coming into being when a pile yarn (15) is pulled through the pile holder (14), as represented in FIG. 1, is absorbed by an antagonistic couple of forces between drive motor (4*a*)-gearwheel (6) and the double-sided guide (12).

Preferably, the pile carriers (12) are installed in a practically horizontal position, but they may also be installed in a vertical or inclined position.

Two lines of drive motors (4) are provided in one module, which has been removably installed.

In order to be able to install the drive motors (4) in modules, with this alternative embodiment for guiding the pile carriers (2) as represented in FIG. 7, the pile carriers (2) with the toothed racks (9) need to be shortened to a length where, in the most advanced position of the pile carrier, the gearwheel (6) is still just engaging the toothed rack (9). In this manner all pile carriers (2) connected to the same module may be shifted over 1 time the pitch in the longitudinal direction, so that the gearwheels (6) will come clear from the toothed racks (9) and the drive motors (4), with the guiding pieces (16) connected to them, may be moved upwards freely.

After the control mechanism of the weaving machine, for instance, the Jacquard machine will have finished to position the pile carriers, so that the pile yarns (15) required will be presented to the rapiers, the rapiers will take the pile yarns (15) and pull them out over the pile length required.

Before the blade now will cut through the pile yarns (15) at the length adjusted by the rapiers, all pile carriers (2) are moved simultaneously in a direction towards the weaver in order to bring the pile yarns (15) into a position assuring a better approach of the perpendicularity with respect to the backing fabric when positioning the pile yarns (15) in the backing fabric.

The advantage of such a method is that the rapier movement, which does not start in the direction of the pile yarn (15) supplied and pulled out, and therefore will adopt an inclined position when pulled out to pile length, will readopt an upright position, by the additional, controlled movement of the control mechanism, for instance, the Jacquard machine.

Activating at least one drive motor for driving a pile carrier (2) according to the embodiment of the invention, as described above may happen according to various principles of action, two possible principles of action of which are described, namely with half reset and without half reset.

With the half reset principle of action, starting happens in full reset. With full reset, all pile carriers (2) are brought into a home position, determined by a mechanical stop, by their respective drive motors (4). With this mechanical stop position, all drive motors (4) and toothed racks (9) are synchronized. From the full reset home position, all pile carriers are activated to a half reset position, being a central position in the middle between two extreme positions for pile selection. From this half reset position, the drive motors (4) are activated, each to have their pile carrier presented the selected pile yarn (15) to their respective rapier (not represented in the figure). In an alternative embodiment each drive motor (4) controls its speed in such a manner that the position for all pile carriers (2) is attained practically simultaneously. After having reached the position for selection, all pile carriers (2) will wait during an anticipated time, first to allow the rapiers to grip the selected pile yarns (15) and secondly to cut off the pile yarns (15). Thereafter, the drive motors (4) are activated, in an alternative embodiment, to bring the pile carriers back into the half-reset position. An optical sensor verifies this position, stopping the weaving machine when not all pile carriers (2) are in position. When the weaving machine is not stopped, this process is repeated from the half reset position.

With the principle of action without half reset, a full reset occurs when starting. With full reset all pile carriers (2) are brought into a home position, determined by a mechanical stop, by their respective drive motors (4). All drive motors (4) and toothed racks (9) are synchronized with this mechanical stop.

From the full reset home position all pile carriers (2) are activated to a half reset position, being a central position in the middle between two extreme positions for pile selection. From this half reset position the drive motors (4) are activated, each to make their pile carrier (2) present the selected pile yarn (15) to the rapier. In an alternative embodiment, each drive motor controls its speed in such a manner that the selection position for all pile carriers (2) is reached practically simultaneously. After having reached the selection position, all pile carriers (2) will wait during an anticipated time to allow the rapiers to grip the selected pile yarns. Thereafter, the drive motors (4) are activated to bring all pile carriers straight to their positions in order to present the following selected pile yarn (15) to the rapier without any possibility to verify that the exact position will be maintained. In an alternative embodiment, activating likewise occurs in a manner that the final position is reached practically simultaneously. This process is repeated from each position of a selected pile yarn (15). It is however indeed possible to shift over to the half reset principle for one cycle, after an adjustable number of selections, and to carry out the optical verification to verify whether all pile carriers (2) are still sufficiently synchronized. Thereafter a restart is made according to the principle of action without half reset.

It is further possible to attribute an offset of a number of motor steps to the complete Jacquard, i.e. all the drive motors (4), in order to compensate a possible set off of the weaving machine, for instance, when the weaving machine has been shifted with respect to the Jacquard part. The central position between the two extreme selection positions or the zero is then transferred over a number of motor steps.

What is claimed is:

1. Method for driving one or several pile carriers (2) for the selection of one or several pile yarns (15), the pile carriers (2) moving between a first and a second extreme position for pile selection, and each pile carrier (2) being directly driven through a drive motor (4), wherein activating the drive motor (4) for driving the pile carrier (2) occurs according to the half reset principle, the pile carrier (2), each time being moved over an intermediate position, this intermediate position being a position between two extreme positions for pile selection, and the position of the pile carrier (2) being verified in this intermediate position.

2. Method for driving one or several pile carriers (2) for the selection of one or several pile yarns (15), the pile carriers (2) moving between a first and a second extreme position for pile selection, and each pile carrier (2) being directly driven through a drive motor (4), wherein activating at least one drive motor (4) for driving a pile carrier (2) occurs without half reset, and after a number of movements of the pile carrier (2) or after a certain time, one half reset movement being performed in verification of the fact whether all pile carriers (2) are still situated in the positions which have been verified, said half reset movement being a movement of one or several pile carriers towards an intermediate position between two extreme positions for pile selection before moving to a next position for color selection.

3. Method according to claim 1, wherein said intermediate position is the middlemost position in the middle between the two extreme positions for pile selection.

4. Method according to claim 1, wherein verifying the central position of a pile carrier (2) occurs by means of a light beam.

* * * * *